United States Patent [19]

Sims

[11] 4,118,691

[45] Oct. 3, 1978

[54] SECURITY SYSTEM FOR A BUILDING

[76] Inventor: Ruth E. Sims, 17811 NW. 14th Pl., Miami, Fla. 33169

[21] Appl. No.: 769,658

[22] Filed: Feb. 17, 1977

[51] Int. Cl.[2] ..... G08B 13/08

[52] U.S. Cl. ..... 222/3; 340/548; 340/565; 116/6; 222/3 G; 109/31

[58] Field of Search ..... 340/63, 274 R, 276; 116/1, 2, 4, 5, 6, 11, 58, 137

[56] References Cited

U.S. PATENT DOCUMENTS

| | | | |
|---|---|---|---|
| 3,214,857 | 11/1965 | Tyrone et al. | 340/276 UX |
| 3,427,608 | 2/1969 | Green | 340/274 |

*Primary Examiner*—Alvin H. Waring
*Attorney, Agent, or Firm*—Robert D. Farkas

[57] ABSTRACT

A spring within a container is maintained in compression by a first movable pin that extends from the inside to the outside of a container. In response to the first pin being pulled from a set position, a spring drives a hammer against a dispensing button of a tear gas cannister whereby the cannister dispenses tear gas. Additionally, a second pin extends from the inside to the outside of the container. In response to the second pin being pulled from a set position, a switch causes the application of a voltage of a battery to a horn whereby the horn emits sound.

1 Claim, 6 Drawing Figures

SECURITY SYSTEM FOR A BUILDING

BACKGROUND OF THE INVENTION

1. Field of the Invention

This invention relates to a security system for a building and more particularly to a system that dispenses tear gas and sounds an alarm when an intruder enters the building.

2. Description of the Prior Art

Because of a rising number of burglaries in the United States, a plethora of security systems for buildings have been developed. Typically, a security system fires a tear gas cartridge and sounds an alarm in response to a pulling of a trip wire that extends across an entrance to a building.

The firing is provided by a firing assembly having a barrel with a chamber block where a firing pin is driven into the cartridge. One disadvantage of the security system is that the firing pin, barrel and chamber block are machined parts that are expensive.

Another disadvantage of the security system is that the trip wire may inadvertently be pulled by a child or a domestic animal. Therefore, it may be desirable to have a security system that is alternatively connected to dispense tear gas or sound an alarm. An inexpensive security system that alternatively dispenses tear gas or sounds an alarm has heretofore been unknown in the prior art.

SUMMARY OF THE INVENTION

An object of the present invention is to either sound an alarm, dispense tear gas or both in a building that is entered by a burglar.

According to a first aspect of the present invention, a spring is maintained in compression by a first movable pin; in response to said first pin being moved, said spring drives a hammer against a dispensing button of a tear gas cannister whereby the cannister dispenses tear gas.

According to a second aspect of the present invention a spring laoded switch is maintained open by a second movable pin; in response to said second pin being moved, said switch closes to cause an alarm to sound.

Other objects, features and advantages of the present invention will become more apparent in the light of the following detailed description of a preferred embodiment as illustrated in the accompanying drawing.

DESCRIPTION OF THE PREFERRED EMBODIMENT

Figure 1:
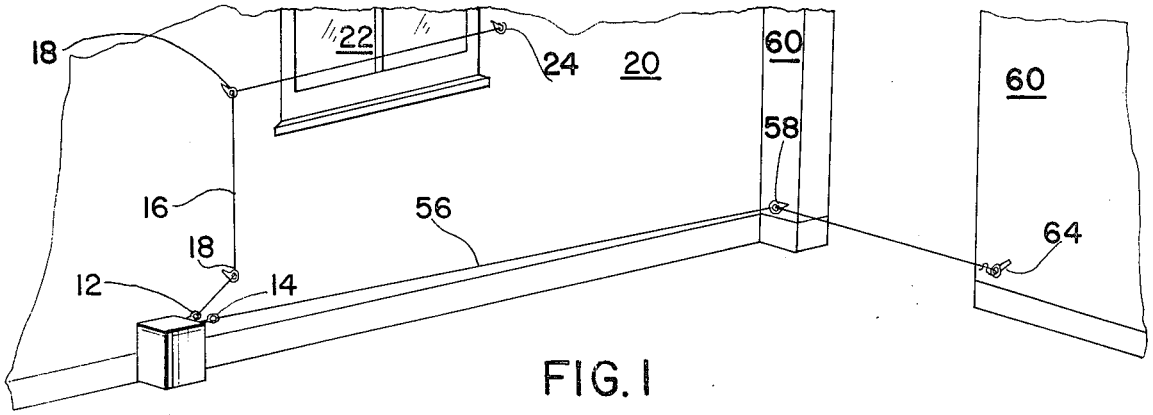
FIG. 1 is a perspective view of a preferred embodiment of the present invention.
Figure 2:
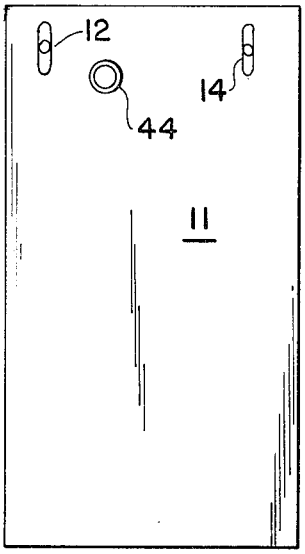
FIG. 2 is a front elevation of the burglar bomb in the embodiment of FIG. 1.

Referring to FIGS. 1 and 2, the subject matter of the present invention is a security system that includes similar movable eye pins 12, 14 each of which extends from the inside to the outside of a container 10 through holes in a wall 11 thereof. Additionally, on the outside of the container 10, the pins 12, 14 have respective eye rings that are fastened to trip wires as explained hereinafter.

The eye ring of the pin 12 is fastened to one end of a frist trip wire 16 that passes through eye screws 18 which are screwed into a wall 20 on one side of a window 22. The other end of the trip wire 16 is fastened to an eye screw 24 that is screwed into the wall 20 on the other side of the window 22 whereby the trip wire 16 is strung across the window 22. Therefore, when an intruder passes through the window 22 and presses against the trip wire 16, the pin 12 is partially pulled from the container 10.

Figure 3:
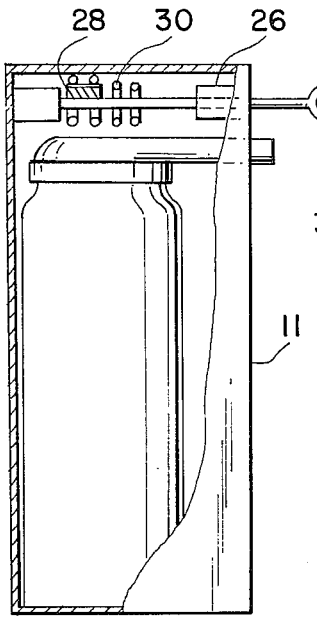
FIG. 3 is a right side elevation of the burglar bomb of FIG. 2 with parts broken away.
Figure 4:
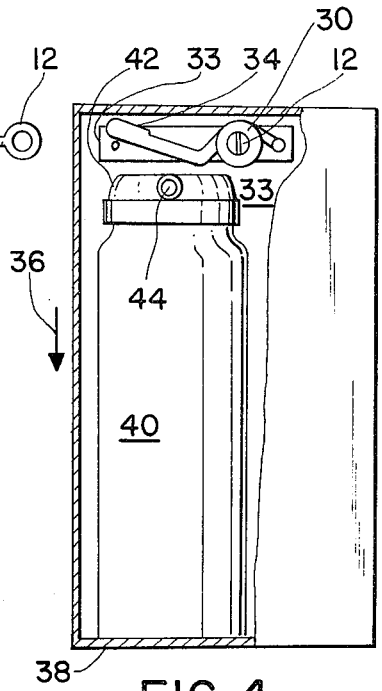
FIG. 4 is a section of a front elevation of the burglar bomb of FIG. 2.

Referring to FIG. 3 and FIG. 4 inside of the container 10, the pin 12 is shown in a set position. The pin 12 is journalled within a sleeve 26 that is integrally connected to the wall 11. Additionally, around the pin 12 is a spring 30 that is connected to a bracket 32 mounted upon a wall 33, opposite the wall 11 of the container 10.

The spring 30 is connected to a hammer 34 whereby the hammer 34 is urged in a direction of an arrow 36. Resting upon a bottom 38 of the container 10 is a tear gas cannister 40. As explained hereinafter, when the burglar presses against the trip wire 16, the cannister 40 dispenses tear gas.

The cannister 40 is similar to well known deodorant dispenser that utilize gas propellants. In response to pressure upon a dispensing button 42 of the cannister 40, the tear gas is dispensed therefrom through a nozzle 44 that extends through a hole in the wall 11.

When the pin 12 is pulled by the trip wire 16 from the set position, the spring 30 drives the hammer 34 against the button 42 whereby the tear gas is dispensed. However, when the pin 12 is in the set position, the spring 30 urges the hammer 34 against the pin 12 whereby the spring 30 is maintained in compression and the hammer 34 is restrained from contact with the button 42.

Figure 6:
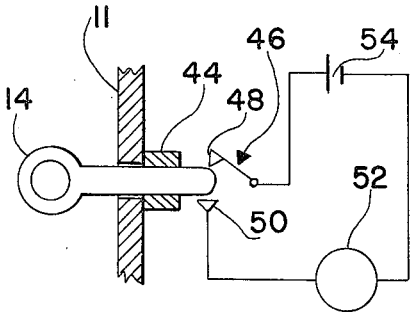
FIG. 6 is a schematic diagram of the connection of a horn to a battery in the burglar bomb of FIG. 2.
Figure 5:
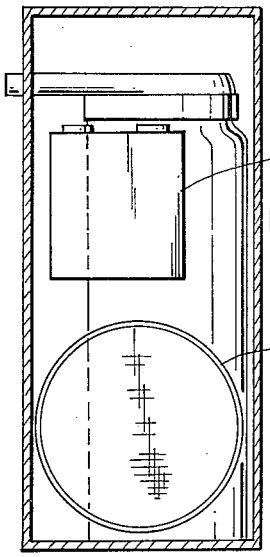
FIG. 5 is a left side elevation of the burglar bomb of FIG. 2 with parts broken away.

Referring to FIG. 5 and FIG. 6, the pin 14 referred to hereinbefore is journalled within a sleeve 44 similar to the sleeve 26. Moreover, included within the container 10 is a spring loaded switch 46 mounted in any suitable manner. When the pin 14 is in a set position within the container 10, a contact 48 of the switch 46 is maintained in an open position. When the pin 14 is pulled from the set position, a spring (not shown) of the switch 46 moves the contact 48 to a closed position thereby rroviding an electrical connection between the contact 48 and a contact 50 of the switch 46.

The contact 50 is connected through a horn 52 to the negative pole of a battery 54. Additionally, the contact 48 is connected to the positive pole of the battery 54. Therefore, in response to the pin 14 being pulled from the set position, the voltage of the battery 54 is applied to the horn 52 thereby causing the horn 52 to emit sound.

Referring to FIG. 1, the eye ring of the pin 14 is fastened to one end of a second trip wire 56 that passes through an eye screw 58 which is screwed into a wall 60 on one side of a doorway 62. The other end of the trip wire 56 is fastened to an eye screw 64 that is screwed into the wall 60 on the other side of the doorway 62. Accordingly, when either the burglar, a child, or a domestic animal presses against the trip wire 56, the pin 14 is moved from the set position and the horn 52 emits sound.

It should be understood that in an alternative embodiment, the pins 12, 14 may both be connected to one trip wire.

Although the invention has been shown and described with respect to a typical embodiment thereof, it should be understood by the skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. A security system for a building, comprising:

a hammer;

a first movable pin adapted for connection to a first trip wire;

a gas dispensing cannister that dispenses a gas in response to the presence of a force upon a dispensing button thereof;

a spring connected to urge said hammer against said first pin when said first pin is in a set position and to bias said hammer against said dispensing button when said first pin is pulled away from said set position by the displacement of the position of said first trip wire;

a second movable pin adapted for connection to a second trip wire; and means for emitting sound in response to said second pin being pulled from another set position by the displacement of the position of said second trip wire, wherein said means for emitting sound includes a voltage source for emitting sound in response to the application of voltage from said source, and a spring loaded switch connected to said second pin to apply said voltage to said sound emitting means in response to said second pin being moved from said set position, whereby said first pin and said second pin may be selectively independently and concurrently displaced from said set position and said another set position respectively.

* * * * *